US010295179B2

(12) United States Patent
Shimazu

(10) Patent No.: US 10,295,179 B2
(45) Date of Patent: May 21, 2019

(54) PREMIXING APPARATUS

(71) Applicant: RINNAI CORPORATION, Nagoya-shi, Aichi (JP)

(72) Inventor: Tomoyuki Shimazu, Nagoya (JP)

(73) Assignee: RINNAI CORPORATION, Aichi (JP)

( * ) Notice: Subject to any disclaimer, the term of this patent is extended or adjusted under 35 U.S.C. 154(b) by 240 days.

(21) Appl. No.: 15/458,172

(22) Filed: Mar. 14, 2017

(65) Prior Publication Data

US 2017/0292697 A1 Oct. 12, 2017

(30) Foreign Application Priority Data

Apr. 6, 2016 (JP) ..... 2016-076518

(51) Int. Cl.

| | |
|---|---|
| ***F23D 14/62*** | (2006.01) |
| ***F23D 14/02*** | (2006.01) |
| ***F23N 1/02*** | (2006.01) |
| ***F23N 3/08*** | (2006.01) |

(52) U.S. Cl.

CPC ..... *F23D 14/02* (2013.01); *F23N 1/025* (2013.01); *F23N 3/085* (2013.01); *F23N 2035/10* (2013.01); *F23N 2035/16* (2013.01)

(58) Field of Classification Search

CPC ..... F23D 14/70; F23D 14/62; F23D 14/34; F23D 14/04; F23N 1/027; F23N 1/025

See application file for complete search history.

(56) References Cited

FOREIGN PATENT DOCUMENTS

JP 2015-230143 A 12/2015

*Primary Examiner* — Jason Lau

(74) *Attorney, Agent, or Firm* — Cermak Nakajima & McGowan LLP; Tomoko Nakajima

(57) ABSTRACT

A premixing apparatus in which a downstream end of a gas supply passage is connected to a gas suction section disposed in an air supply passage on an upstream side of a fan, is provided with: a butterfly valve driven by a stepping motor, for changing over, between high and low, a ventilation resistance in that section of the air supply passage which is on an upstream side of the gas suction section; a changeover valve for changing over, between high and low, a ventilation resistance in that section of the gas supply passage which is on an upstream side of a flow control valve; and an interlocking mechanism which opens or closes the changeover valve in interlocking with the rotation of the butterfly valve and which maintains the changeover valve in a closed state until the butterfly valve has rotated from the closed posture toward the opening side by a predetermined angle. Flame failure and poor combustion are prevented at the time of changing over the butterfly valve and the changeover valve from closed posture to opened posture. When the butterfly valve is rotated from the closed posture into the opened posture, a driving frequency of the stepping motor is made higher, until the butterfly valve has rotated from the closed posture toward the opening side by a predetermined set angle, than the driving frequency during the subsequent operation of the butterfly valve.

2 Claims, 5 Drawing Sheets

PREMIXING APPARATUS

TECHNICAL FIELD

The present invention relates to a premixing apparatus for mixing fuel gas with air to supply thus obtained air-fuel mixture to a burner through a fan.

BACKGROUND ART

As this kind of premixing apparatus, the following is known in JP-A-2015-230143; that is, a downstream end of that gas supply passage for supplying fuel gas which has interposed therein a flow control valve, is connected to a gas suction section disposed in an air supply passage on an upstream side of the fan. The premixing apparatus comprises: an air resistance changeover means for changing over, between high and low, a ventilation resistance in that section of the air supply passage which is on an upstream side of the gas suction section; and a gas resistance changeover means for changing over, between high and low, a ventilation resistance in that section of the gas supply passage which is on the downstream side of the flow control valve.

By the way, in case a proportional valve is used as the flow control valve, the proportional valve is controlled so that the fuel gas can be supplied in amount depending on the required combustion amount. Further, the fan revolution is controlled depending on the required combustion amount so that the air-fuel ratio of the air-fuel mixture to be supplied to the burner becomes constant. However, in case the required combustion amount falls below a predetermined value and, as a result, the fan revolution has fallen below a lower limit revolution below which the proportional characteristics of the air supply amount cannot be maintained, or in case the electric current to the proportional valve (electric current to be charged to the proportional valve) has fallen below a lower limit electric current below which the proportional characteristics of the gas supply amount cannot be maintained, the air or fuel gas in amount depending on the required combustion amount can no longer be supplied.

In addition, as the flow control valve, there is a case in which is used a zero governor that maintains the secondary gas pressure to the atmospheric pressure. In this case, the amount of fuel gas supply varies with the differential pressure between the atmospheric pressure that is the secondary gas pressure and the negative pressure inside the air supply passage. And since the negative pressure inside the air supply passage varies with the fan revolution, the amount of fuel gas supply varies with the fan revolution, i.e., the amount of air supply. It follows that, by controlling the fan revolution depending on the required combustion amount, the amount of air and fuel gas depending on the required combustion amount will be supplied to the burner.

Also in this arrangement, if the fan revolution has fallen below a lower limit revolution at which the proportional characteristics of the air supply amount can be maintained, the air or fuel gas depending on the required fuel amount can no longer be supplied. Therefore, when the required combustion amount has fallen below a predetermined amount, it is necessary to increase the ventilation resistance in the air supply passage by the air resistance changeover means. Then, without making the fan revolution below the above-mentioned lower limit value, the amount of air depending on the required combustion amount below the predetermined value can be supplied. Further, only by increasing the ventilation resistance in the air supply passage, the amount of fuel gas supply will exceed the amount corresponding to the required combustion amount due to an increase in the negative pressure in the air supply passage. It is therefore necessary also to increase the ventilation resistance in the gas supply passage at the time when the ventilation resistance in the air supply passage is increased.

As a solution, in the above-mentioned prior art example, the following arrangement has been employed; i.e., when the required combustion amount has fallen below the predetermined value, the ventilation resistance in the air supply passage is increased by the air flow resistance changeover means, and also the ventilation resistance in the gas supply passage is increased by the gas resistance changeover means, thereby attaining a small-capacity state in which the air and fuel gas in an amount responding to the required combustion amount below the predetermined value can be supplied. In addition, when the required combustion amount has exceeded the predetermined value, the ventilation resistance in the air supply passage is decreased by the air resistance changeover means and also the ventilation resistance in the gas supply passage is decreased by the gas resistance changeover means, thereby returning to a large-capacity state.

In the above-mentioned prior art described in JP-A-2015-230143, the air resistance changeover means is constituted by a butterfly valve that is rotated by a stepping motor into an opened posture parallel with the longitudinal direction of the air supply passage, and a closed posture at right angles to the longitudinal direction of the air supply passage. The gas resistance changeover means is constituted by a changeover valve disposed in the gas supply passage in an openable and closable manner. And an interlocking mechanism is further provided to cause the changeover valve to be operated into an opened posture or into a closed posture in interlocking with the rotation of the butterfly valve.

By the way, until the butterfly valve has rotated, to a certain degree, from the closed posture to the opening side to a certain degree, the air flow amount will not increase considerably. Therefore, if the changeover valve starts to open simultaneously with the butterfly valve's starting to rotate from the closed posture to the opened posture, the gas flow amount will increase before the air flow amount has not increased considerably. As a result, at the time of changing over from the small-capacity state to the large-capacity state, the air-fuel mixture will become temporarily gas-rich, thereby giving rise to poor combustion.

Therefore, in the art described in the patent document JP-A-2015-230143, the interlocking mechanism is constituted such that the changeover valve is maintained in the closed state until the butterfly valve has rotated from the closed posture toward the opening side by a predetermined angle. Then, at the time of changing over from the small-capacity state to the large-capacity state, the gas flow amount can be prevented from increasing before the air flow amount increases. In this arrangement, however, it has been found that, at the time of changing over from the small-capacity state to the large-capacity state, the air-fuel mixture becomes a state of being excessively air rich, with a possibility of flame failure since the air-fuel mixture becomes excessively air-rich state. Further, it has also been found that, right after the changeover valve has started to open, the excess air ratio of the air-fuel mixture becomes a minimum value close to 1.0, giving rise to a possibility of poor combustion.

SUMMARY

Technical Problem

In view of the above point, this invention has a problem of providing a premixing apparatus in which there can be prevented a trouble such as flame failure or poor combustion at the time of switching from the small-capacity state to the large-capacity state. That is, the trouble in question is due to happen when an interlocking mechanism is constituted such that the changeover valve is maintained in the closed state until the butterfly valve rotates from the closed posture into an opening side by a predetermined angle.

Solution to Problem

In order to solve the above problem, this invention is a premixing apparatus for mixing fuel gas with air to supply thus obtained air-fuel mixture, through a fan, to a burner, in which a downstream end of a gas supply passage having interposed therein a flow control valve for supplying fuel gas is connected to a gas suction section disposed in an air supply passage on an upstream side of the fan. The premixing apparatus comprises: an air resistance changeover means for changing over, between high and low, a ventilation resistance in that section of the air supply passage which is on an upstream side of the gas suction section; a gas resistance changeover means for changing over, between high and low, a ventilation resistance in that section of the gas supply passage which is on a downstream side of the flow control valve, wherein the air resistance changeover means is constituted by a butterfly valve disposed in that section of the air supply passage which is on the upstream side of the gas suction section, the butterfly valve being rotated by a stepping motor into an opened posture parallel with a longitudinal direction of the air supply passage or into a closed posture at right angles to the longitudinal direction of the air supply passage, wherein the gas resistance changeover means is constituted by a changeover valve disposed in the gas supply passage in an openable and closable manner. The premixing apparatus further comprises: an interlocking mechanism causing the changeover valve to open or close in interlocking with the rotation of the butterfly valve into the opened posture or the closed posture, the interlocking mechanism being so arranged that, until the butterfly valve has been rotated from the closed posture toward the opening side by a predetermined angle, the changeover valve is maintained in the closed state. The premixing apparatus is characterized in that, when the butterfly valve is rotated from the closed posture into the opened posture, a driving frequency of the stepping motor is made higher, until the butterfly valve has rotated from the closed posture toward the opening side by a predetermined set angle, than the driving frequency during the time at which the butterfly valve rotates from the said set angle to the opened posture.

According to this invention, until the butterfly valve has rotated from the closed posture to the opening side by a predetermined set angle, the stepping motor will be driven at a relatively high speed. Therefore, even if there is a point at which the air-fuel mixture becomes a state of being excessively air rich, this point can be quickly passed, thereby giving rise to no flame failure. In addition, after the butterfly valve has rotated by the set angle, the output torque of the stepping motor will increase as a result of lowering in the driving frequency. Therefore, the butterfly valve and the changeover valve can be surely opened.

In addition, in this invention, the set angle shall preferably be set to an angle beyond a point at which, after the changeover valve starts opening, the excess air ratio of the air-fuel mixture becomes a minimum value. According to this arrangement, the point at which the excess air ratio of the air-fuel mixture becomes the minimum value can also be quickly passed. Therefore, even if the minimum value of the excess air ratio becomes close to 1.0, poor combustion does not occur.

DESCRIPTION OF EMBODIMENTS

Figure 1:
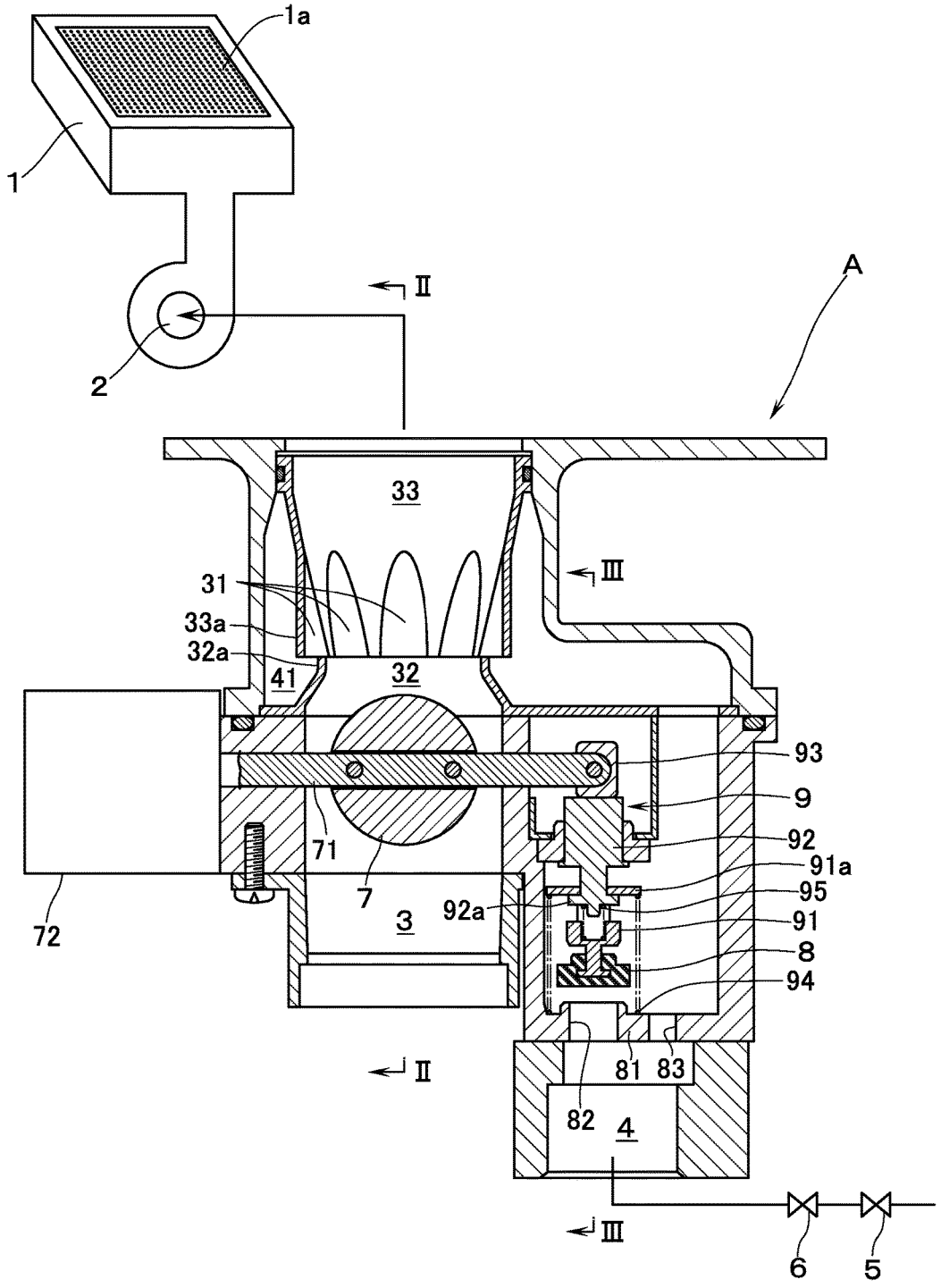
FIG. 1 is a side view, partly shown in section, of a premixing apparatus according to an embodiment of this invention.

With reference to FIG. 1, reference numeral 1 denotes a burner which is made up of a totally aerated combustion type burner (also called "all primary air burner") and the like having a combustion surface 1*a* in which the air-fuel mixture is ejected and combusted. The burner 1 has connected thereto a fan 2 and, by means of a premixing apparatus A according to an embodiment of this invention, the fuel gas is mixed with air so that air-fuel mixture is supplied to the burner 1 via the fan 2.

The premixing apparatus A is provided with an air supply passage 3 on an upstream side of the fan 2, and a gas supply passage 4 to supply the fuel gas. In the upstream section of the gas supply passage 4, there are interposed a gate valve 5, and a flow control valve 6 which is made up of a proportional valve or a zero governor. Further, the downstream end of the gas supply passage 4 is connected to a gas suction section 31 which is disposed in the air supply passage 3.

In addition, the premixing apparatus A is provided with: an air resistance changeover means for changing over, between high and low, a ventilation resistance in that section of the air supply passage which is on an upstream side of the gas suction section 31; and a gas resistance changeover means for changing over, between high and low, a ventilation resistance in that section of the gas supply passage 4 which is on the downstream side of the flow control valve 6. When the required combustion amount has fallen below a predetermined value, a small-capacity state is attained in which the ventilation resistance in the air supply passage 3 is made high by the air resistance changeover means and also in which the ventilation resistance in the gas supply passage 4 is made high by the gas resistance changeover means. It is thus so arranged that the amount of air and fuel gas depending on the required combustion amount below the required value can be supplied. Further, when the required combustion amount has exceeded the predetermined value, there will be restored (or returned to) a large-capacity state in which the ventilation resistance in the air supply passage 3 is made low by the air resistance changeover means and in which the ventilation resistance in the gas supply passage 4 is made low by the gas resistance changeover means.

Figure 2:
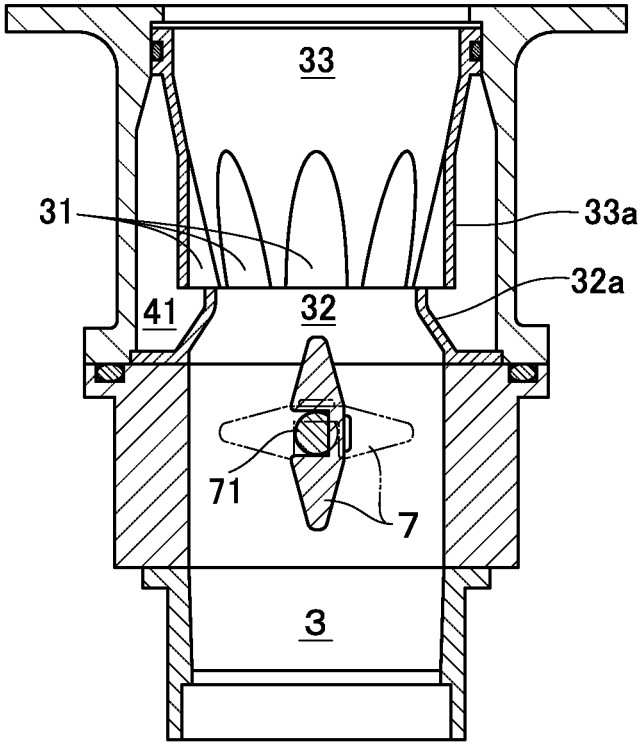
FIG. 2 is a plan view partly cut away along the line II-II in FIG. 1.

With reference also to FIG. 2, the air resistance changeover means is constituted by a butterfly valve 7 which is rotatably disposed, with a shaft 71 serving as the center of rotation, in that section of the air supply passage 3 which is on an upstream side of the gas suction section 31, and which is made up of a disc of slightly smaller diameter than that of the air supply passage 3. The shaft 71 of the butterfly valve 71 has connected thereto a stepping motor 72. At the time of changing over to the small-capacity state, the butterfly valve 7 is rotated by the stepping motor 72 from the opened posture which is parallel with the longitudinal direction of the air supply passage 3, as shown in solid lines in FIGS. 1 and 2, to the closed posture which is at right angles to the longitudinal direction of the air supply passage 3 as shown in imaginary lines in FIG. 2. In the closed posture the air flows only through the clearance between the inner circumferential surface of the air supply passage 3 and the outer peripheral surface of the butterfly valve 7. The ventilation resistance in the air supply passage 3 therefore becomes high.

In that section of the air supply passage 3 which is on the downstream side of the butterfly valve 7, there are disposed: a Venturi section 32 which is coaxial with, and smaller in sectional area than, that section of the air supply passage 3 which has disposed therein the butterfly valve 7; and an enlarged diameter section 33 whose sectional area gets gradually larger from the Venturi section 32 toward the downstream side. At the downstream end of the gas supply passage 4 there is provided a gas chamber 41 which encloses the Venturi section 32 and the enlarged diameter section 33. At that base end section of the enlarged diameter section 33 which is closer to the Venturi section 32, there is provided a gas suction section 31 which is in communication with the gas chamber 41. The gas suction section 31 is formed by severing the circumferential wall 33*a* of the enlarged diameter section 33 at part of the base end side away from the circumferential wall 32*a* of the Venturi section 32 and then expanding the severed portions diametrically outward. The gas suction section 31 is formed in a plurality of pieces along the circumference at even interval from one another. It is thus so arranged that the fuel gas can be suctioned from the gas chamber 41 into an entire circumference of the base end section.

The gas resistance changeover means is constituted by a changeover valve 8 which is disposed in the gas supply passage 4 in an openable and closable manner. The changeover valve 8 is disposed above, and so as to face, a valve seat 81 which is provided in a manner to cross the gas supply passage 4. The valve seat 81 has formed therein: a valve hole 82 which is to be opened or closed by the changeover valve 8; and a bypass hole 83 which is normally left in communication. In this arrangement, when the changeover valve 8 is lowered and seated onto the valve seat 81, the valve hole 82 is blocked, and there will be attained a state in which the fuel gas flows only through the bypass hole 83. As a result, the flow resistance in the gas supply passage 4 becomes high.

Figure 3:
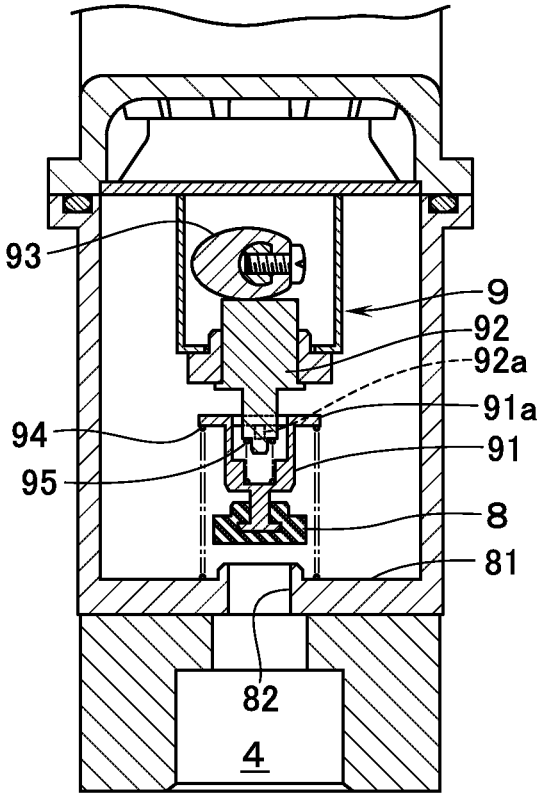
FIG. 3 is a sectional view partly cut away along the line III-III in FIG. 1.

The changeover valve 8 is operated to be opened or closed through the interlocking mechanism 9 accompanied by the rotation of the butterfly valve 7. This interlocking mechanism 9 is constituted, as shown in FIGS. 1 and 3, by: a connector member 91 connected to an upper part of the changeover valve 8; a pressing member 92 disposed above that side of the connector member 91 which is opposite to the changeover valve 8, i.e., above the connector member 91; a cam 93 attached to an end portion of the shaft 71 of the butterfly valve 7 so as to come into contact with the pressing member 92; a return spring 94 to urge the changeover valve 8, through the connector member 91, upward toward the opening side; and a cushion spring 95 interposed between the connector member 91 and the pressing member 92, the cushion spring 95 having a larger spring constant than that of the return spring 94. At the lower end of the pressing member 92, there is formed a projection 92*a* which is capable of being engaged with the lower surface of a spring shoe 91*a* for the return spring 94 that is integral with the connector member 91.

Figure 4:
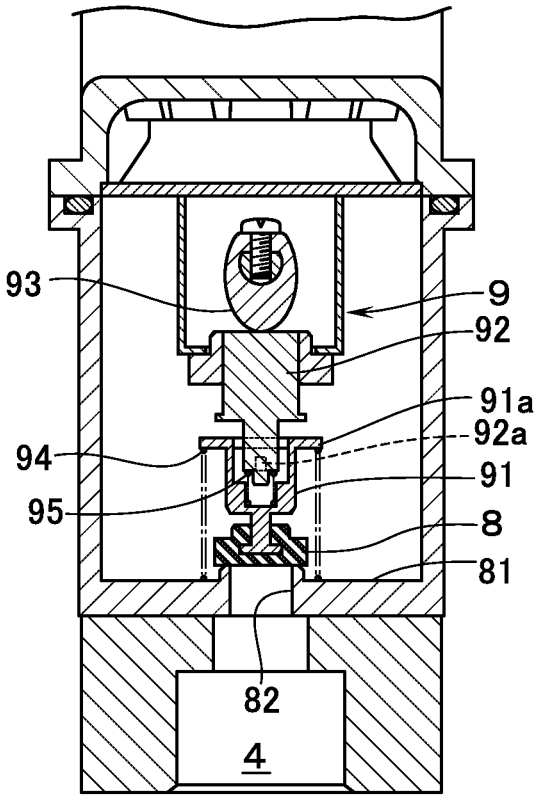
FIG. 4 is a sectional view corresponding to FIG. 3 when the butterfly valve is rotated to the closed posture.

When the butterfly valve 7 is rotated from the opened posture to the closed posture side, the pressing member 92 is pushed by the cam 93 and is moved downward. Once the pressing member 92 has lowered, by means of the pressing force to be transmitted through the cushion spring 95, the connector 91 is moved downward against the pressing force of the return spring 94. Then, before the butterfly valve 7 reaches the closed posture, the changeover valve 8 will be seated on the valve seat 81, thereby closing the valve. Thereafter, during the time before the butterfly valve 7 reaches the closed posture, as shown in FIG. 4, the cushion spring 95 will be compressed accompanied by the lowering movement of the pressing member 92. When the butterfly valve 7 is rotated from the closed posture to the opened posture side, the changeover valve 8 will be maintained at the closed state due to the pressing force of the cushion spring 95 until the butterfly valve 7 has angle θ1 (see FIG. 5). Once the butterfly valve 7 has rotated by the predetermined angle θ1, the pressing member 92 moves up to the position at which the projection 92*a* comes into contact with the lower surface of the spring shoe 91*a*. Thereafter, following the upward movement of the pressing member 92, the connector member 91 will move upward and, consequently, the changeover valve 8 will be opened.

Figure 5:
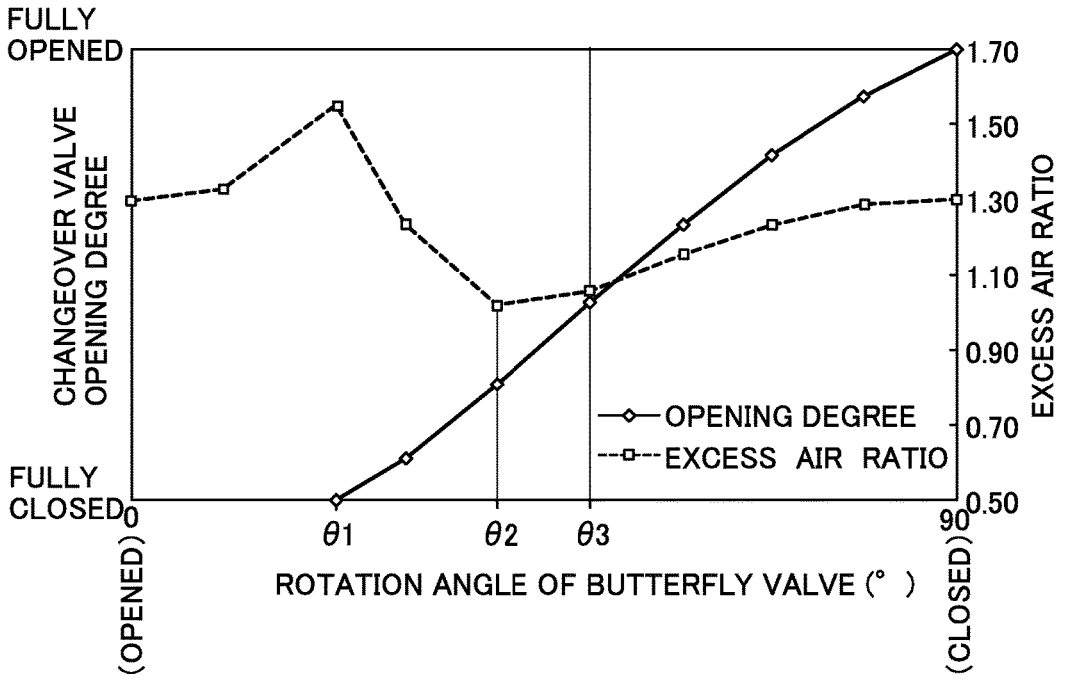
FIG. 5 is a graph showing the changes in excess air ratio of air-fuel mixture in relation to the rotation angle of the butterfly valve.

FIG. 5 shows the relationship among the rotation angle of the butterfly valve 7, the opening degree of the changeover valve 8, and the excess air ratio of the air-fuel mixture. Until the butterfly valve 7 has rotated, to a certain degree, from the closed posture to the opening side, the air flow amount will not increase considerably, and the changeover valve 8 will be maintained at the closed posture. Therefore, during the above-mentioned period of time, the excess air ratio of the air-fuel mixture shows little or no change from an appropriate value of 1.30. Thereafter, during the time until the rotation angle of the butterfly valve 7 has reached the predetermined angle θ1, the excess air ratio gradually increases. Once the rotation angle of the butterfly valve 7 has exceeded the predetermined angle θ1 so that the changeover valve 8 has started to open, the excess air ratio gradually decreases. When the rotation angle of the butterfly valve 7 has reached an angle θ2, the excess air ratio becomes a minimum value in the neighborhood of 1.0. Thereafter, accompanied by the increase in the rotation angle of the butterfly valve 7, the excess air ratio gradually increases toward the appropriate value.

If the time in which the rotation angle of the butterfly valve 7 stays in the neighborhood of θ1 is long, the air-fuel mixture will be in an excessively air-rich state, resulting in a possibility of flame failure. In addition, if the time in which the rotation angle of the butterfly valve 7 stays in the neighborhood of θ2 is long, the air-fuel mixture will be in an excessively gas-rich state, resulting in a possibility of giving rise to poor combustion.

As a solution, in the embodiment of this invention, suppose that an angle θ3 as shown in FIG. 5 is defined as a predetermined set angle beyond the angle θ2 that is a point at which the changeover valve 8 starts opening and, consequently, the excess air ratio of the air-fuel mixture becomes minimum. Then, it is arranged to perform the following control. In other words, at the time when the butterfly valve 7 is rotated from the closed posture to the opened posture, the driving frequency of the stepping motor 72 is made higher, until the butterfly valve 7 rotates from the closed posture to the opening side by (i.e., in the amount of) the set angle θ3, than the driving frequency until the butterfly valve 7 is rotated from the said set angle θ3 to the opened posture. For example, the driving frequency of the stepping motor 72 is made to be 500 pps during the time in which the butterfly valve 7 is rotated from the closed posture to the opening side by the set angle of θ3 and is made to be 200 pps during the time when the butterfly valve 7 rotates from the said set angle θ3 to the opened posture.

According to this arrangement, the butterfly valve 7 will be made to rotate quickly from the closed posture to the set angle θ3. Therefore, the time at which the rotation angle of the butterfly valve stays in the neighborhood of θ1 and the time to stay in the neighborhood of θ2 become short. The occurrence of flame failure and poor combustion can therefore be effectively prevented. In addition, after the butterfly valve 7 has rotated to the set angle θ3, the output torque of the stepping motor 72 increases as a result of lowering in the driving frequency. The butterfly valve 7 and the changeover valve 8 can be surely opened.

Embodiments of this invention have been described with reference to the figures, but this invention shall not be limited thereto. For example, the changeover valve may be disposed to be closed by seating on the lower surface of the valve seat 81 in FIGS. 1, 3 and 4. Also, the interlocking mechanism may be constituted by: a cam which is connected to the shaft 71 of the butterfly valve 7; a rod whose upper end comes into contact with the cam and which is connected to the changeover valve through the valve hole 82; and a valve spring which urges the changeover valve toward the closing side. It is thus so arranged that the rod is pushed down by the cam as a result of rotation of the butterfly valve 7 from the closed posture and that the changeover valve is made to be opened against the valve spring. In this case, if the cam is formed such that the pushing by the rod is not started until the butterfly valve 7 has rotated from the closed posture to the opening side by a predetermined angle, the changeover valve can be maintained at the closed posture until the butterfly valve 7 is rotated from the closed posture toward the opening side by a predetermined angle.

REFERENCE SIGNS LIST

A premixing apparatus
1 burner
2 fan
3 air supply passage
31 gas suction section
4 gas supply passage
6 flow control valve
7 butterfly valve
8 changeover valve
9 interlocking mechanism
θ1 predetermined angle
θ2 point at which the excess air ratio of the air-fuel mixture becomes minimum
θ3 set angle

What is claimed is:

1. A premixing apparatus for mixing fuel gas with air to supply thus obtained air-fuel mixture, through a fan, to a burner, in which a downstream end of a gas supply passage having interposed therein a flow control valve for supplying fuel gas is connected to a gas suction section disposed in an air supply passage on an upstream side of the fan, the premixing apparatus comprising:

an air resistance changeover means for changing over, between high and low, a ventilation resistance in that section of the air supply passage which is on an upstream side of the gas suction section;

a gas resistance changeover means for changing over, between high and low, a ventilation resistance in that section of the gas supply passage which is on a downstream side of the flow control valve, wherein the air resistance changeover means is constituted by a butterfly valve disposed in that section of the air supply passage which is on the upstream side of the gas suction section, the butterfly valve being rotated by a stepping motor into an opened posture parallel with a longitudinal direction of the air supply passage or into a closed posture at right angles to the longitudinal direction of the air supply passage, wherein the gas resistance changeover means is constituted by a changeover valve disposed in the gas supply passage in an openable and closable manner;

an interlocking mechanism causing the changeover valve to open or close in interlocking with the rotation of the butterfly valve into the opened posture or the closed posture, the interlocking mechanism being so arranged that, until the butterfly valve has been rotated from the closed posture toward the opening side by a predetermined angle, the changeover valve is maintained in the closed state, characterized in that, when the butterfly valve is rotated from the closed posture into the opened posture, a driving frequency of the stepping motor is made higher, until the butterfly valve has rotated from the closed posture toward the opening side by a predetermined set angle, than the driving frequency during the time at which the butterfly valve rotates from the said set angle to the opened posture.

2. The premixing apparatus according to claim 1, wherein the said set angle is set to an angle beyond a point at which, after the changeover valve starts opening, the excess air ratio of the air-fuel mixture becomes a minimum value.

* * * * *